United States Patent [19]

Dufrane et al.

[11] Patent Number: 4,914,306

[45] Date of Patent: Apr. 3, 1990

[54] VERSATILE COMPOSITE RADIATION SHIELD

[76] Inventors: Kenneth H. Dufrane, 7 Holly La., Avon, Conn. 06001; Kevin R. Kingsley, 45 King St., Danbury, Conn. 06811

[21] Appl. No.: 231,252

[22] Filed: Aug. 11, 1988

[51] Int. Cl.[4] ..... G21F 5/00

[52] U.S. Cl. ..... 250/506.1; 250/515.1

[58] Field of Search ..... 250/506.1, 507.1, 515.1; 376/272

[56] References Cited

U.S. PATENT DOCUMENTS

| | | | |
|---|---|---|---|
| 2,928,948 | 3/1960 | Silversher | 250/108 |
| 3,727,059 | 4/1973 | Reese | 250/108 R |
| 3,731,101 | 5/1973 | Peterson et al. | 250/108 R |
| 3,732,423 | 5/1973 | Peterson | 250/108 R |
| 3,751,669 | 8/1973 | Bush, Jr. | 250/506 |
| 3,770,964 | 11/1973 | Backus | 250/506 |
| 3,774,037 | 11/1973 | Backus | 250/506 |
| 3,780,306 | 12/1973 | Anderson et al. | 250/428 |
| 3,781,189 | 12/1973 | Kasberg | 176/28 |
| 3,845,315 | 10/1974 | Blum | 250/506 |
| 3,962,587 | 6/1976 | Dufrane et al. | 250/506 |
| 4,197,467 | 4/1980 | Williams | 250/506 |
| 4,272,683 | 6/1981 | Baatz et al. | 250/507 |
| 4,445,042 | 4/1984 | Baatz et al. | 250/506.1 |
| 4,451,739 | 5/1984 | Christ et al. | 250/506.1 |
| 4,650,518 | 3/1987 | Arntzen et al. | 420/3 |
| 4,752,437 | 7/1988 | Ito et al. | 250/506.1 |

*Primary Examiner*—Bruce C. Anderson

*Attorney, Agent, or Firm*—Michael A. Mann

[57] ABSTRACT

A composite radiation shield which provides physical and economic benefits for the shielding of radiation especially in containers for transporting radioactive material. The composite radiation shield contains rods of a high density material such as depleted uranium or tungsten. The spaces between the rods may contain smaller rods and are also backfilled with lead or other preferably high density material with a melting point lower than the material of the rods. The rod diameters and arrangement can be easily customized to accommodate any radiation shield configuration needed.

32 Claims, 2 Drawing Sheets

VERSATILE COMPOSITE RADIATION SHIELD

FIELD OF THE INVENTION

The present invention relates to containers for the transport and storage of radioactive material and to radiation shields for such material.

Radioactive materials present a potential personnel hazard and as such need to be isolated from the public in general. Radioactive materials are unique among hazardous materials, including chemical and biological agents, in that certain types of radiation emitted by various radioisotopes can physically pass through a finite thickness of any material. Containers for the transport and storage of radioactive materials must have radiation shields designed to substantially attenuate radiation to prevent harmful amounts of radiation from exiting the container. Furthermore, the container must have sufficient structural toughness to withstand accidents without loss of radioactive material or damage to the physical integrity of the shielding. Material suitable as shielding is not always suitable for giving strength to the container. Therefore, shields and containers are frequently made of different materials. The choice of materials and their configuration involves balancing the oftentimes competing considerations of cost of materials, cost of fabrication, material weight, container capacity, design cost, licensing cost and effort and the type of radioactive material to be contained.

The present invention represents an improvement in the prior art of shield and container design by providing a composite, high-performance radioactivity shield that can be optimized for specific applications, is less susceptible to structural damage and is lower in cost of materials and fabrication.

One particular form of radiation energy which must be accounted for in a shield design is gamma radiation. In general, high density materials such as iron, steel and lead are typically used in container designs. Typically, lead is the preferred shielding material, but other high density shield materials have also been used.

Traditional shield designs are generally lead sandwiched between steel plates. Although the steel does provide a degree of shielding, its main purpose is to provide structural strength to the container.

In the design of containers, or casks, for the storage and transportation of radioactive materials, the shielding efficiency, which relates the overall container weight and the weight of the radioactive material contained, is strongly affected by the contaIner geometry. More specifically, in a cylindrical container having a given shield material and thickness, the container weight can be reduced by minimizing the container diameter. If a more effective shielding material is chosen, a thinner shield can be fabricated to produce the same radiation attenuation. Thus, the use of a more effective shield material allows both the shield thickness and overall container diameter to be reduced saving both material cost and weight without reducing the degree of radiation attenuation or the amount of radioactive material in the container.

Materials with densities higher than lead, such as depleted uranium and, to a lesser extent, tungsten, have previously been used as shield radioactive materials to minimize size and weight of the shielding and container. Based on thickness, depleted uranium is twice as effective as lead for shielding gamma radiation. The following table shows the shield thickness relative to lead of various materials used as gamma radiation shields for a common radioisotope (Cobalt-60):

| MATERIAL | RELATIVE SHIELD THICKNESS |
|---|---|
| Concrete | 7.1 |
| steel | 2.2 |
| Lead | 1.0 |
| Depleted Uranium | 0.5 |

Although depleted uranium is the most effective, available shielding material, difficulties related to the structural integrity and the high cost of manufacturing depleted uranium shields have limited its applicability.

In the past shields have been designed using depleted uranium castings. However, cast depleted uranium tends to be brittle and porous. Meeting design and licensing objectives with cast depleted uranium, therefore, proves exceedingly difficult. Furthermore, the variety of uses for this material in large sections other than for shielding is extremely limited. Consequently, there are no facilities in this country that have the capability to supply the depleted uranium castings in the size and shape needed. Still further, the depleted uranium must be custom made for each container. All of these considerations increase the cost of using depleted uranium shielding in cast form.

One proposal for fabricating larger, more practical containers is to assemble a larger shield from multiple small castings of depleted uranium. However, in addition to the problem of casting depleted uranium in general, the "building block" approach also has significant disadvantages. One significant problem area is the "streaming" of gamma radiation through the joints which inevitably exist between each cast segment. Minimization of this streaming effect requires the use of complex joint configuration designs which are both expensive to fabricate and have reduced structural properties. Any separation between two castings increases the streaming and lessens the effectiveness of the shield. Furthermore, these smaller castings must still be custom made for each size and shape of container.

OBJECTS OF THE INVENTION

Accordingly, it is an object of the present invention to provide a composite radiation shield using depleted uranium or other high density material which overcomes the foregoing disadvantages.

Specifically, it is an object of the present invention to provide a composite radiation shield which uses depleted uranium or other high density material which is relatively inexpensive to manufacture, readily available and which can be made in a variety of sizes and shapes without custom casting of the depleted uranium or other high density material.

It is a further object of the present invention to provide a composite radiation shield which uses depleted uranium or other high density material and which avoids the problem of radiation streaming present in the prior art.

It is still a further object of the present invention to provide a compact shield for radioactive materials which has improved structural properties and is less prone to brittleness.

It is still a further object of the present invention to improve the payload to weight ratio of containers for transporting radioactive material.

SUMMARY OF THE INVENTION

These objects and others which will become apparent to those skilled in the art upon reading the following detailed description are achieved in the present invention, which provides a radiation shield having longitudinal solid rods of depleted uranium or other high density material surrounded by a metal alloy matrix which fills all the spaces between the rods.

Preferably, the composite radiation shield is used in conjunction with a container having walls to provide support for the radiation shield.

DETAILED DESCRIPTION

Figure 1:
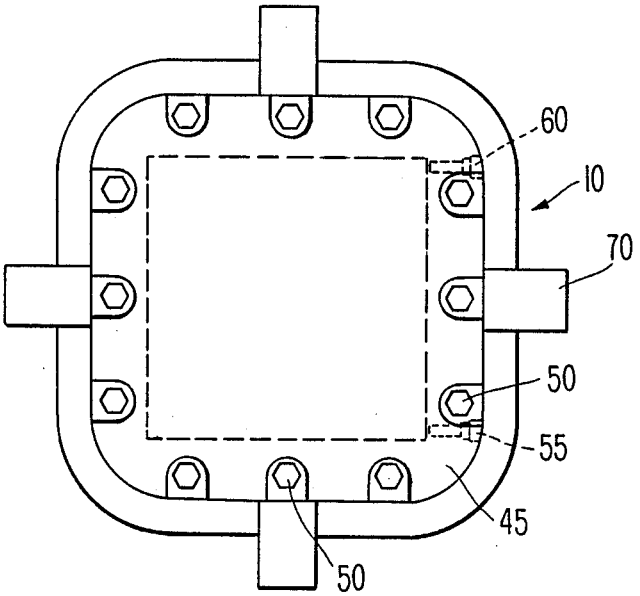
FIG. 1 is a plan view of a container for radioactive material incorporating the composite radiation shield of the present invention.
Figure 2:
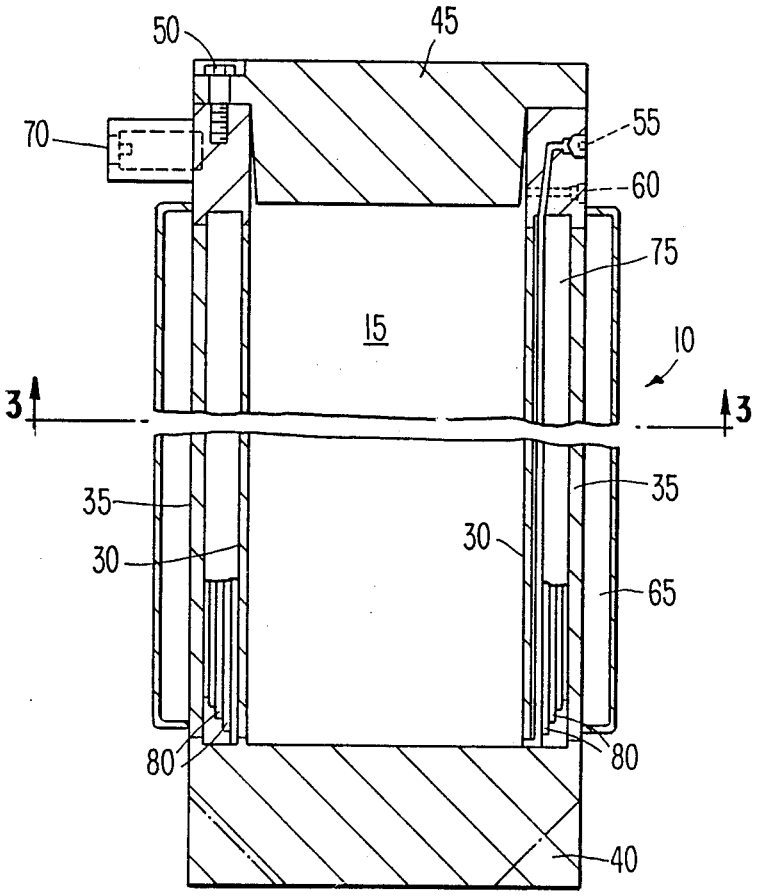
FIG. 2 is a cross sectional elevation view of the container of FIG. 1, taken along the line 2—2, showing the construction of the composite radiation shield in the walls of the container.
Figure 3:
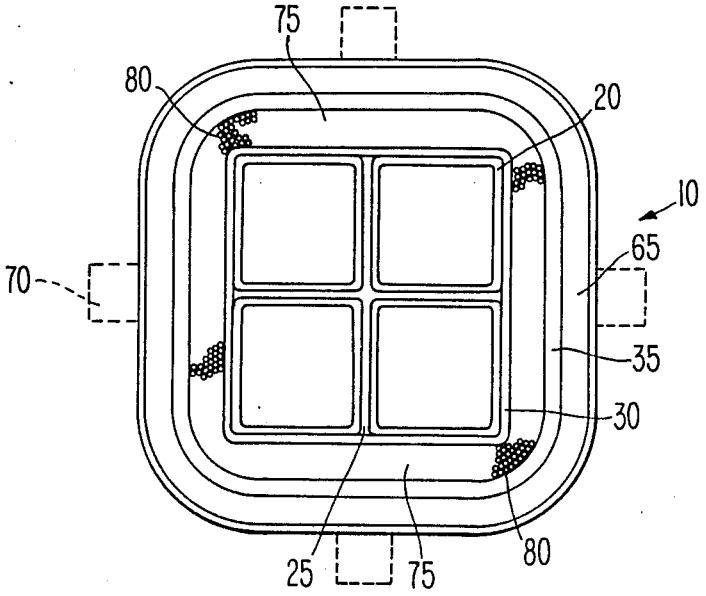
FIG. 3 is a cross sectional plan view of the container of FIG. 1, taken along the broken line of FIG. 2.

Referring now to the drawings in detail, and initially to FIGS. 1, 2 and 3, a container 10 for the containment of radioactive material is illustrated. The contaIner 10 has a cavity 15 for containing the radioactive material. This cavity 15 is conveniently divided into four quadrants by inner containers 20, which are in turn separated by walls 25. These inner containers 20 and walls 25 provide structural support and, where required, nuclear criticality safety for the container payload.

The container 10 has an inner wall 30, preferably made of steel or stainless steel for structural strength and for enclosing the radioactive material. The container 10 also has an outer wall 35, preferably made of steel or stainless steel for structural strength, which is spaced apart from the inner wall 30.

The container 10 also has a bottom member 40, constructed of a material with suitable structural strength and radiation shielding properties, such as steel or stainless steel.

The container 10 also has a cover member 45 constructed of a material with suitable structural strength and radiation shielding properties, such as steel or stainless steel, and secured to the walls 30 and 35 of the container by bolts 50, or in any other convenient manner, including welding. The container 10 also has container penetration and inspection openings 55 and 60 which permit sampling of the contents of the container from the top and bottom, respectively. The container is provided with an outer chamber 65, which is filled with a suitable neutron shielding material, such as borated water, polyethylene or other hydrogenous material. For lifting the container, trunions 70, extend outwardly from the exterior and to which trunions cables or hooks can be attached.

In between the inner wall 30 and the outer wall 35 of the container is illustrated a composite radiation shield 75 in accordance with the present invention. This composite radiation shield includes a plurality of longitudinal rods 80, which have a large length to diameter or thickness ratios. These rods are substantially solid and preferably extend the entire length of the space between the inner and outer walls 30 and 35.

Figure 4:
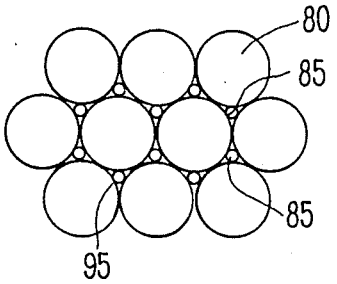
FIG. 4 is a partial detailed view of an embodiment of a composite radiation shield which has regularly packed large round rods of depleted uranium or other high density material with small round rods placed among the large rods.
Figure 6:
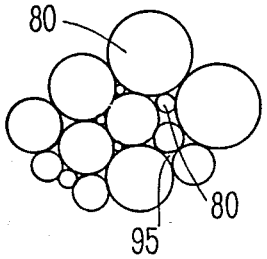
FIG. 6 is a partial detailed view of an embodiment of the composite radiation shield which has randomly packed round rods of various sizes of depleted uranium or other high density material.

These rods may be of any convenient shape, but are preferably round in cross section, as shown in FIG. 4. For most efficient packing density, the rods are preferably packed in a regularly spaced triangular configuration, as shown in FIG. 4 for the larger diameter rods. It is not necessary, however, that all rods be of the same diameter, since randomly arranged round rods 80, of varying diameters will also work in the present invention, as shown in FIG. 6.

Although not necessary for the present invention, small rods 85, also preferably of depleted uranium, are advantageously interposed in the interstitial spaces between the larger rods, as opposed to remaining space.

The diameter of solid rods 80 should be sized to achieve an optimum packing density of the uranium within the required space between the inner and outer walls.

Unlike cast depleted uranium sections, depleted uranium rods contemplated for use in the present invention are mass-produced items available "off-the-shelf" in a variety of sizes and shapes adequate to accommodate most any shield configuration. Advantageously, round rods are ½" in diameter and 13 to 15 feet long, although the particular length chosen depends upon the size of the shield and the container. Based on geometric packing theory with a triangular pitch array of round rods, the achievable volume fraction of rods within the proposed annulus is approximately 78% using a single rod diameter.

This volume fraction permits the shield design and cask weight design objectives to be satisfied without the need to pursue the higher volume fractions, and so, for ease of construction, the design using a single size rod is preferred. However, if desired, an increase in this volume fraction can be readily achieved by inserting smaller diameter rods among the larger rods. Using ½" diameter rods as the larger size, and 5/32" diameter rods for the interstitial spaces between the larger diameter rods, it is possible to achieve volume fractions of 85%.

Figure 5:
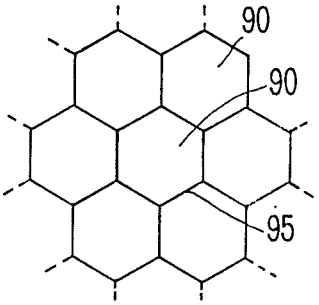
FIG. 5 is a partial detailed view of an embodiment of the composite radiation shield which has regularly packed hexagonal rods of depleted uranium or other high density material.

For maximum volume fraction packing efficiency, rods having triangular, rectangular or hexagonal shape may be used. An arrangement of hexagonal rods 90, is depicted in FIG. 5. The packing efficiency of this arrangement approaches 100%.

In addition to configuration flexibility in the radial direction, rods 80 of varying lengths may also be used to provide axial shaping of the radiation shield, as depicted in FIG. 2, since the radioactivity of the material to be contained may vary in the axial direction. By varying the axial position of the shorter rods with respect to longer rods, the amount of shielding can be made to correspond to the level of radioactivity at each point in the axial direction of the radioactive material. Axial shaping of the shield is a form of weight optimization because it reduces the amount of shielding material in areas of decreased radiation levels. Conversely, the amount of shielding material may be increased only where required by placing short, smaller diameter rods 85 in the interstitial spaces among larger diameter rods where the level of radioactivity, in the axial direction is greatest. For example, if spent nuclear fuel is the radioactive material to be contained, less shielding would be needed toward the ends of the fuel and more may be needed in the axial region just below the midpoint of the fuel.

Regardless of the particular rod shape or packing configuration of the high density material, the composite shield arrangement is then completed by backfilling the remaining space 95 around and between the depleted uranium rods with an easily poured, high density material which has a melting point lower than that of depleted uranium, preferably lead or other high density alloys. The lead backfill, by filling the gaps or joints between the depleted uranium rods, further increases the shielding effectiveness of the composite, improves heat transfer across the wall of the container and reduces the streaming of gamma radiation. Alternatively, to reduce manufacturing costs, the backfill material may be a gas such as helium or air if the heat transfer and shielding requirements can be satisfied.

Thus, the composite radiation shield of the present invention has a variety of advantages over solid depleted uranium. Because depleted uranium rods in a wide range of shapes, diameters, lengths and other alloys are readily available, the proposed shield configuration will be far less expensive to manufacture, and will not require custom molds and casting. Furthermore, the structural properties of depleted uranium rods are well known and easily confirmed by testing. The capability to manufacture a wide variety of rod shapes, lengths and diameters, with good quality control, exists.

Furthermore, the composition or alloy used for the depleted uranium rod and backfill material can be varied to satisfy additional design requirements for the resultant shield, such as heat transfer characteristics and structural performance.

The composite radiation shield of the present invention is particularly well adapted for use in containers for transporting and storing radioactive material. Such containers for radioactive materials must satisfy design and licensing requirements for structural integrity in normal and accident situations as well as provide sufficient radiation attenuation. Cast depleted uranium tends to be somewhat brittle, requires multiple castings with the inevitable interfaces between castings and requires greater use of structural steel shells around the depleted uranium to provide the necessary strength. In the present invention, the composite combination of highly ductile lead with depleted uranium rods minimizes the tendency towards brittleness of the shield, thus reducing the amount of structural steel needed to strengthen a composite shield compared to that required for cast depleted uranium alone. Furthermore, cracking as the result of brittleness is less of a problem in a configuration of depleted uranium rods than in depleted uranium castings because cracks in a rod will not propagate beyond the individual rod and there would be many rods surrounding the cracked rod to provide shielding backup. In addition, extruded depleted uranium rods are less brittle than castings and their quality is much easier to control and verify.

Accordingly, the overall performance characteristics of the composite shield permit the resultant shield to be lighter than conventional shield materials, such as lead, having equivalent radiation attenuation capability, but with significant cost and structural advantages over cast depleted uranium. This benefit is especially important in the transportation of radioactive materials where it is desirable to minimize the weight of the container and maximize the amount of material which can be carried per shipment.

Although depleted uranium has been discussed as an example of a suitable material for the rods 75, 75', 80 and 90, it is apparent that other high density radiation attenuating material, such as tungsten or molybdenum, may also be employed instead or in conjunction with the depleted uranium. Similarly, although lead has been discussed as suitable for filling substantially all the remaining space between the rods, other material which has radiation shielding properties and is solid at normal temperatures, but has a lower melting point than the material of the rods, may also be employed. If the attenuation of the radiation by the rods alone is sufficient, a backfill material such as helium or air may be chosen for further costs savings.

The terms and expressions used herein are terms of description and not of limitation and there is no intention in the use of such terms and expressions to exclude any equivalents of the features shown or described or portions thereof. Although an illustrative embodiment of the invention has been described herein with reference to the accompanying drawings, it is to be understood that various changes and modifications can be effected therein without departing from the scope or spirit of the present invention.

What is claimed is:

1. A radiation shield comprising: a plurality of closely packed longitudinal substantially solid rods having large ratios of major dimension, said rods being composed of a first material predominantly including depleted uranium, and a second material interposed in any space remaining between said rods and substantially filling such space, said first material having a substantially higher melting point than said second material.

2. The radiation shield defined in claim 1 wherein said second material is solid at normal operating temperatures.

3. The radiation shield defined in claim 2, wherein said second material predominately includes lead.

4. The radiation shield defined in claim 2, wherein said rods are substantially round in cross section.

5. The radiation shield defined in claim 2, wherein said rods are substantially rectangular in cross section.

6. The radiation shield defined in claim 2, wherein said rods are substantially hexagonal in cross section.

7. The radiation shield defined in claim 2, wherein said rods are substantially triangular in cross section.

8. The radiation shield defined in claim 3, wherein said rods comprise a plurality of first rods having first diameters, and a plurality of second rods having substantially smaller diameters than said first diameters of said first rods which second rods are disposed among said first rods.

9. The radiation shield defined in claim 2, wherein the length and axial placement of said rods are varied in order to shape said radiation shield to correspond to an axially varying level of radioactivity.

10. The radiation shield defined in claim 1, wherein said second material predominately includes helium.

11. A container for containment of radioactive material, said container comprising:

an inner steel wall and an outer steel wall spaced away from said inner steel wall, and a radiation shield interposed between said inner steel wall and said outer steel wall, said shield including a plurality of closely packed longitudinal substantially solid rods having large ratios of major dimension to minor dimension, said rods being composed of a first material predominantly including depleted uranium, and a second material interposed in any space remaining between said rods and substantially filling said space, said first material having a higher melting point than said second material.

12. The container for containment of radioactive material defined in claim 11 wherein the second material is solid at normal operating temperatures.

13. The container for containment of radioactive material defined in claim 12, wherein said second material predominately includes lead.

14. The container for containment of radioactive material defined in claim 12, wherein said rods are substantially round in cross section.

15. The container for containment of radioactive material defined in claim 14, wherein said rods comprise a plurality of first rods having first diameters, and a plurality of second rods having substantially smaller diameters than said first rods and which second rods are disposed among said first rods.

16. The container for containment of radioactive material defined in claim 12, wherein said rods are substantially rectangular in cross section.

17. The container for containment of radioactive material defined in claim 12, wherein said rods are substantially hexagonal in cross section.

18. The container for containment of radioactive material defined in claim 12, wherein said rods are substantially triangular in cross section.

19. The container for containment of radioactive material defined in claim 12, wherein the length and axial placement of said rods is varied in order to shape said radioactive shield to correspond to an axially varying level of radioactivity.

20. The container for containment of radioactive material defined in claim 11, wherein said second material predominately includes helium.

21. A composite for shielding against radiation, said composite made by the process of:

packing closely a plurality of longitudinal rods having large ratios of major dimension to minor dimension, said rods composed of a first material predominantly including depleted uranium; and pouring a second material having a high density and a lower melting temperature than said first material in any interstitial spaces between said closely packed rods.

22. The composite of claim 21 wherein said packing step further comprises the step of:

interspersing a plurality of first rods between a plurality of second rods, said first rods having smaller diameters than said second rods, to reduce the volume of said interstitial spaces.

23. The composite of claim 22 wherein first rods are shorter than said second rods and said radioactive shield composite process further includes the step of:

varying the axial position of said plurality of first rods with respect to said plurality of second rods so that said composite provides shielding corresponding to the level of radioactivity at each point in the axial direction.

24. The composite of claim 23 wherein said second material predominantly includes lead.

25. The composite of claim 22 wherein said second material predominantly includes lead.

26. The composite of claim 21 wherein said second material predominantly includes lead.

27. A method for making a shield for radioactivity comprising the steps of:

packing closely a plurality of longitudinal rods having large ratios of major dimension to minor dimension, said rods composed of a first material predominantly including depleted uranium; and pouring a second material having a high density and a lower melting temperature than said first material in any interstitial spaces between said closely packed rods.

28. The composite of claim 27 wherein said packing step further comprises the step of:

interspersing a plurality of first rods between a plurality of second rods, said first rods having smaller diameters than said second rods, to reduce the volume of said interstitial spaces.

29. The composite of claim 28 wherein first rods are shorter than said second rods and said radioactive shield composite process further includes the step of:

varying the axial position of said plurality of first rods with respect to said plurality of second rods so that said composite provides shielding corresponding to the level of radioactivity at each point in the axial direction.

30. The composite of claim 29 wherein said second material predominantly includes lead.

31. The composite of claim 28 wherein said second material predominantly includes lead.

32. The composite of claim 27 wherein said second material predominantly includes lead.

* * * * *